US007263918B1

(12) United States Patent
Chen

(10) Patent No.: US 7,263,918 B1
(45) Date of Patent: Sep. 4, 2007

(54) RATCHET STRUCTURE FOR A WRENCH

(75) Inventor: Chiu-Tang Chen, Kaohsiung Hsien (TW)

(73) Assignee: Cheng-Tsan Hu, Tainan Hsien (TW)

( * ) Notice: Subject to any disclaimer, the term of this patent is extended or adjusted under 35 U.S.C. 154(b) by 0 days.

(21) Appl. No.: 11/428,773

(22) Filed: Jul. 5, 2006

(51) Int. Cl.
*B25B 13/46* (2006.01)

(52) U.S. Cl. ..... 81/63.1; 192/43.2

(58) Field of Classification Search ..... 81/63.1, 81/62; 192/43.2
See application file for complete search history.

(56) References Cited

U.S. PATENT DOCUMENTS 657,512 A * 9/1900 Carter et al. ..... 81/63.1
849,230 A * 4/1907 Gobel ..... 81/63.1
973,779 A * 10/1910 Hansen ..... 81/177.9
1,050,312 A * 1/1913 Stenersen ..... 81/63.1
1,890,213 A * 12/1932 Cameron et al. ..... 140/119
2,193,984 A * 3/1940 Rhinevault ..... 192/43.2
5,174,176 A * 12/1992 Krivec ..... 81/63.1
5,501,124 A * 3/1996 Ashby ..... 81/58.2
5,622,089 A * 4/1997 Gifford, Sr. ..... 81/62
6,308,594 B1 * 10/2001 Cheng ..... 81/62
7,146,881 B2 * 12/2006 Chang ..... 81/62
2006/0090608 A1 * 5/2006 Tsai ..... 81/59.1

* cited by examiner

*Primary Examiner*—D. S. Meislin
(74) *Attorney, Agent, or Firm*—WPAT, P.C.; Anthony King

(57) ABSTRACT

A ratchet structure of a wrench includes a handle, a socket, a first detent, a first elastic element, a second detent, a second elastic element, a lid and a knob. The outer periphery of the socket is formed with gear teeth. The socket is accommodated in the handle. The first and second detents and the first and second elastic elements are also accommodated in the handle, respectively. Each of the first and second detents is provided with gear teeth and a stud. The lid is secured to the handle and covers the detents and the elastic elements. The knob is pivotally connected to the handle. By turning the knob, the studs are linked to turn to change the turning direction of the socket.

3 Claims, 4 Drawing Sheets

RATCHET STRUCTURE FOR A WRENCH

BACKGROUND OF THE INVENTION

1. Field of the Invention

The present invention relates to a ratchet structure for a wrench, in particular to a ratchet using an engaging block of a knob to link a stud of a detent so as to control the turning direction of a socket.

2. Description of the Prior Art

A ratchet structure for a wrench is well known to users, such as U.S. Pat. No. 5,875,693 (incorporated herein by reference in its entirety) which uses gear teeth to mesh with each other to secure the turning direction. However, this design encounters securing problem and damages the product.

SUMMARY OF THE INVENTION

It is the primary objective of the present invention to provide a ratchet structure for a wrench, which utilizes a knob to control a stud of a detent to change the turning direction of a socket.

The present invention comprises a handle, a socket, a first detent, a first elastic element, a second detent, a second elastic element, a lid and a knob. The handle comprises a chamber and a pair of recesses interconnected with the chamber. The socket comprises a through hole to receive a tool therein. The socket further comprises gear teeth around its outer circumference and is secured in the chamber of the handle. The gear teeth of the socket correspond to the recesses. The first detent and the second detent are located in the recesses of the handle. Each of the first and the second detents comprises gear teeth corresponding to the gear teeth of the socket and a stud corresponding to an engaging block of the knob. The knob is pivotally connected to the handle. The first elastic element and the second elastic element engage with the chamber of the handle and rear ends of the first detent and the second detent, respectively. The first detent and the second detent are secured within the handle with the gear teeth engaging with the gear teeth of the socket. The lid is then used to cover the detents and the elastic elements and comprises locating holes corresponding in position to the recesses. The knob further comprises a third elastic element to be located in either of the locating holes of the lid so that the knob is able to switch the turning direction of the socket, and it is done by the engaging block to link the stud, which brings one of the detents to engage with the socket. The gear teeth of one of the detents engage with the gear teeth of the socket to change the turning direction of the socket.

DETAILED DESCRIPTION OF THE PREFERRED EMBODIMENT

Figure 1:
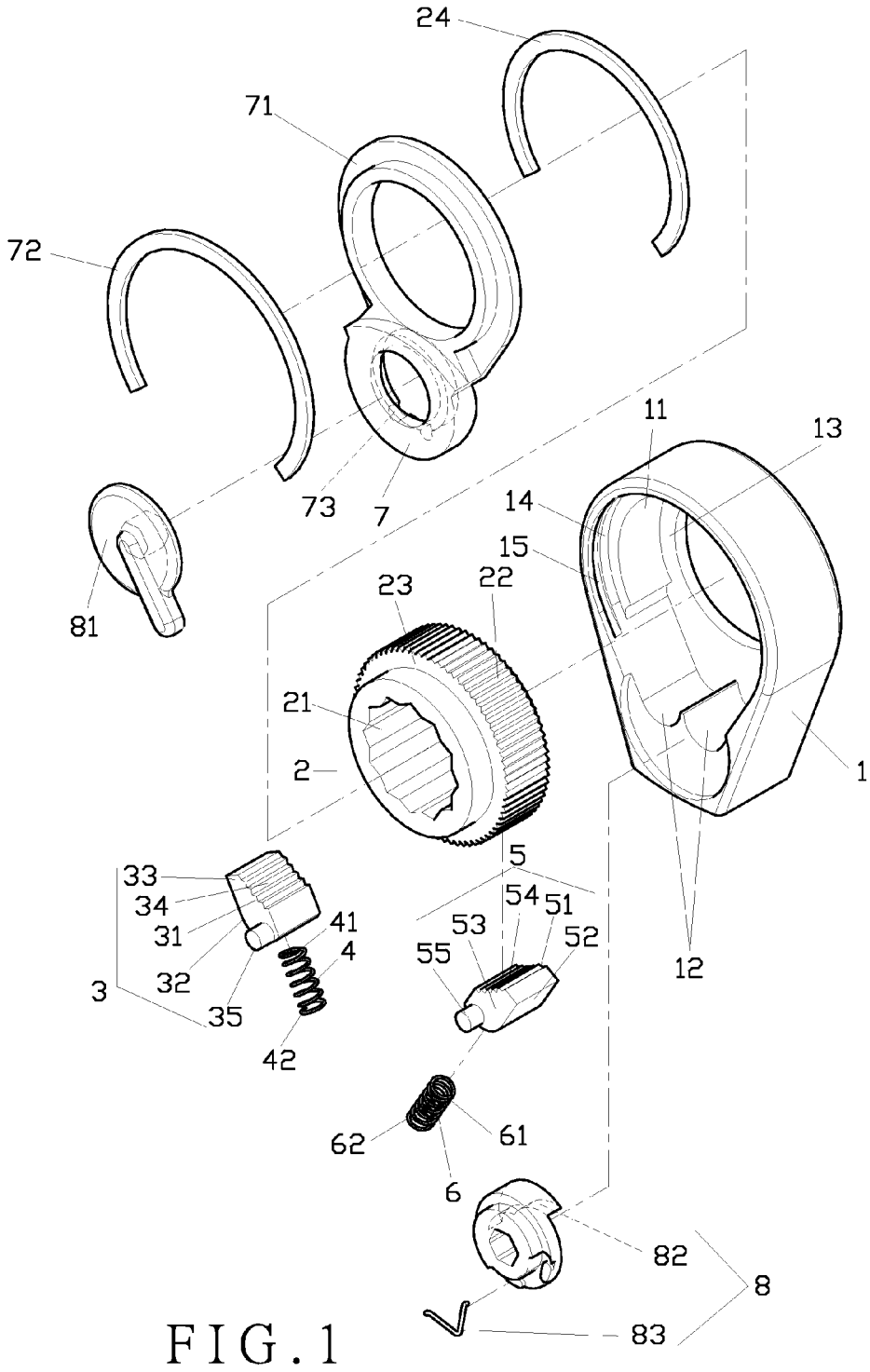
FIG. 1 is an exploded view of the present invention.
Figure 2:
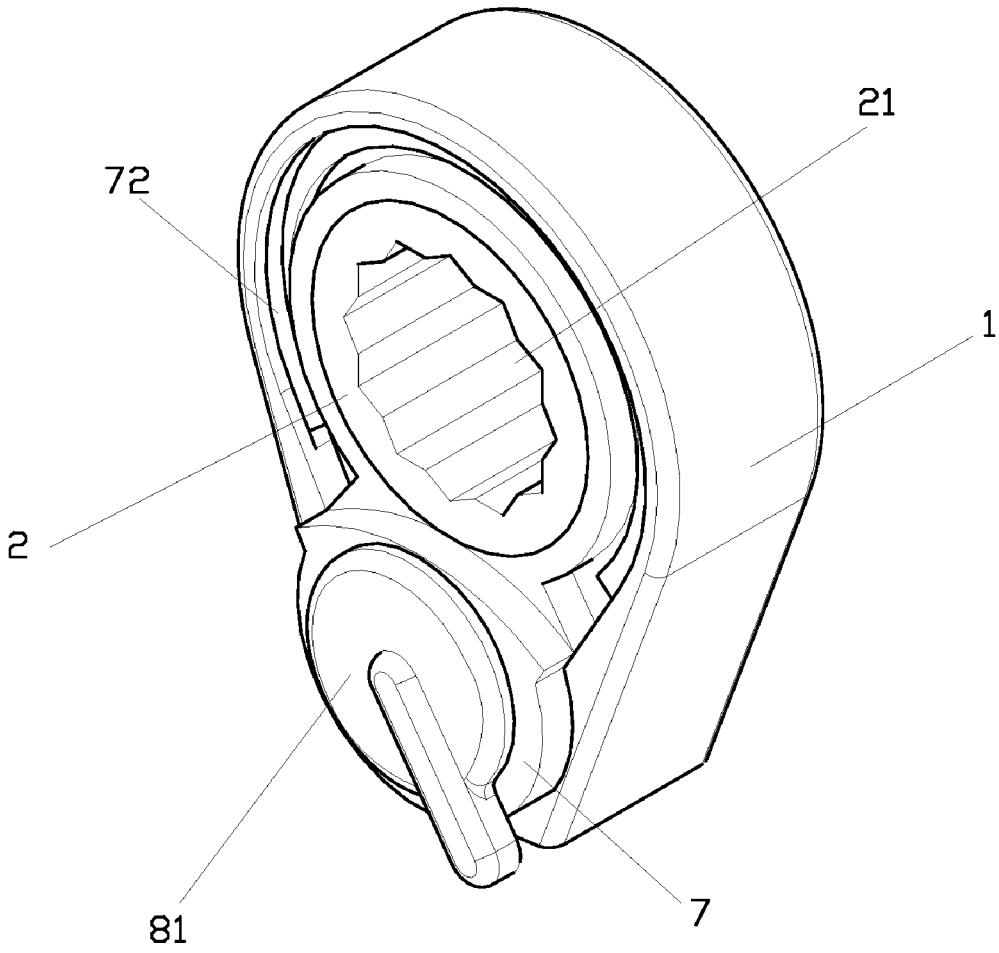
FIG. 2 is a perspective view of the present invention.

As shown in FIGS. 1 and 2, a preferred embodiment of the present invention comprises a handle 1, a socket 2, a first detent 3, a first elastic element 4, a second detent 5, a second elastic element 6, a lid 7 and a knob 8.

The handle 1 comprises a chamber 11, a pair of recesses 12, a stopping ring 13, a first groove 14 and a second groove 15. The recesses 12 are interconnected with the chamber 11. The stopping ring 13 is located in a lower portion of the chamber 11. The first groove 14 and the second groove 15 are located in an upper portion of the chamber 11.

The socket 2 comprises a through hole 21 to receive a tool therein (not shown in the drawings). The outer periphery of the socket 2 is formed with gear teeth 22 and a first reduced section 23. The socket 2 is accommodated in the chamber 11 of the handle 1 and stopped by the stopping ring 13. The gear teeth 22 correspond to the recesses 12. The socket 2 further comprises a first fastening member 24 corresponding in position to the first reduced section 23. The first fastening member 24 is a C-shaped clip, which is secured in the first groove 14 and engages with the first reduced section 23.

The first detent 3 is located in one of the recesses 12 of the handle 1 and comprises a front end 31 and a relative rear end 32. A flat surface 33 is formed between the front end 31 and the rear end 32. The front end 31 is formed with gear teeth 34 corresponding to the gear teeth 22 of the socket 2. The flat surface 33 is provided with a first stud 35 protruding thereof.

The first elastic element 4 comprises a first end 41 and a relative second end 42. The first end 41 engages with the rear end 32 of the detent 3, while the second end 42 engages with the chamber 11 of the handle 1.

The second detent 5 is accommodated in the other of the recesses 12 of the handle 1. The second detent 5 comprises a front end 51 and a relative rear end 52. A flat surface 53 is formed between the front end 51 and the rear end 52. The front end 51 is formed with gear teeth 54 corresponding to the gear teeth 22 of the socket 2. The flat surface 53 is provided with a second stud 55 protruding thereof.

The second elastic element 6 comprises a first end 61 and a relative second end 62. The first end 61 engages with the rear end 52 of the second detent 5, while the second end 62 engages with the chamber 11 of the handle 1.

The lid 7 covers the first detent 3, the first elastic element 4, the second detent 5, and the second elastic element 6. The lid 7 comprises a second reduced section 71 and is secured by a second fastening member 72 in the second groove 15 of the handle 1. The second fastening member 72 is a C-shaped clip. The lid 7 further comprises locating holes 73 corresponding in position to the recesses 12.

The knob 8 comprises a switch 81, an engaging block 82 and a third elastic element 83. The engaging block 82 is pivotally connected to the lid 7 and engages with the first stud 35 and the second stud 55. The third elastic element 83 is located in either of the locating holes 73 of the lid 7.

Figure 3:
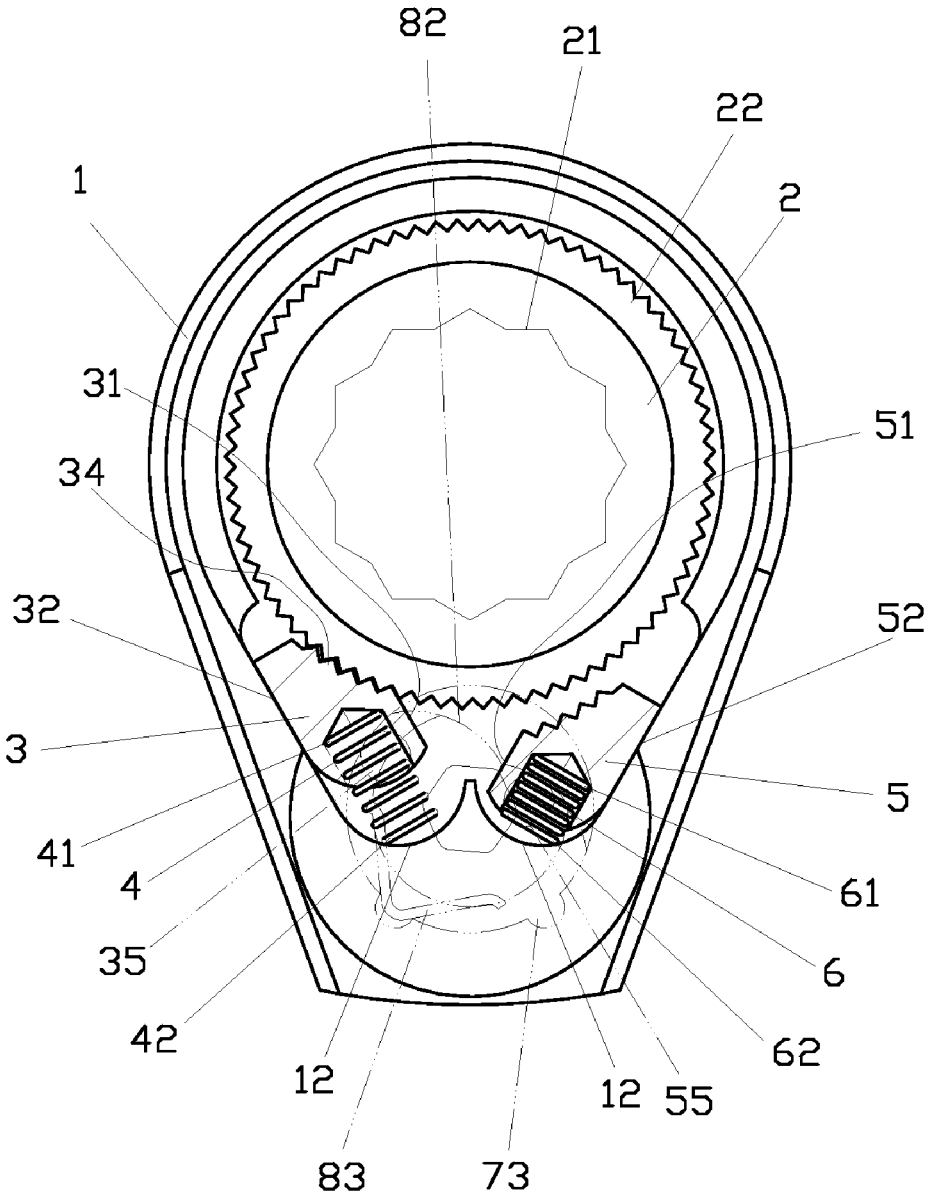
FIG. 3 is a top cross-sectional view of the present invention in a clockwise rotation direction.
Figure 4:
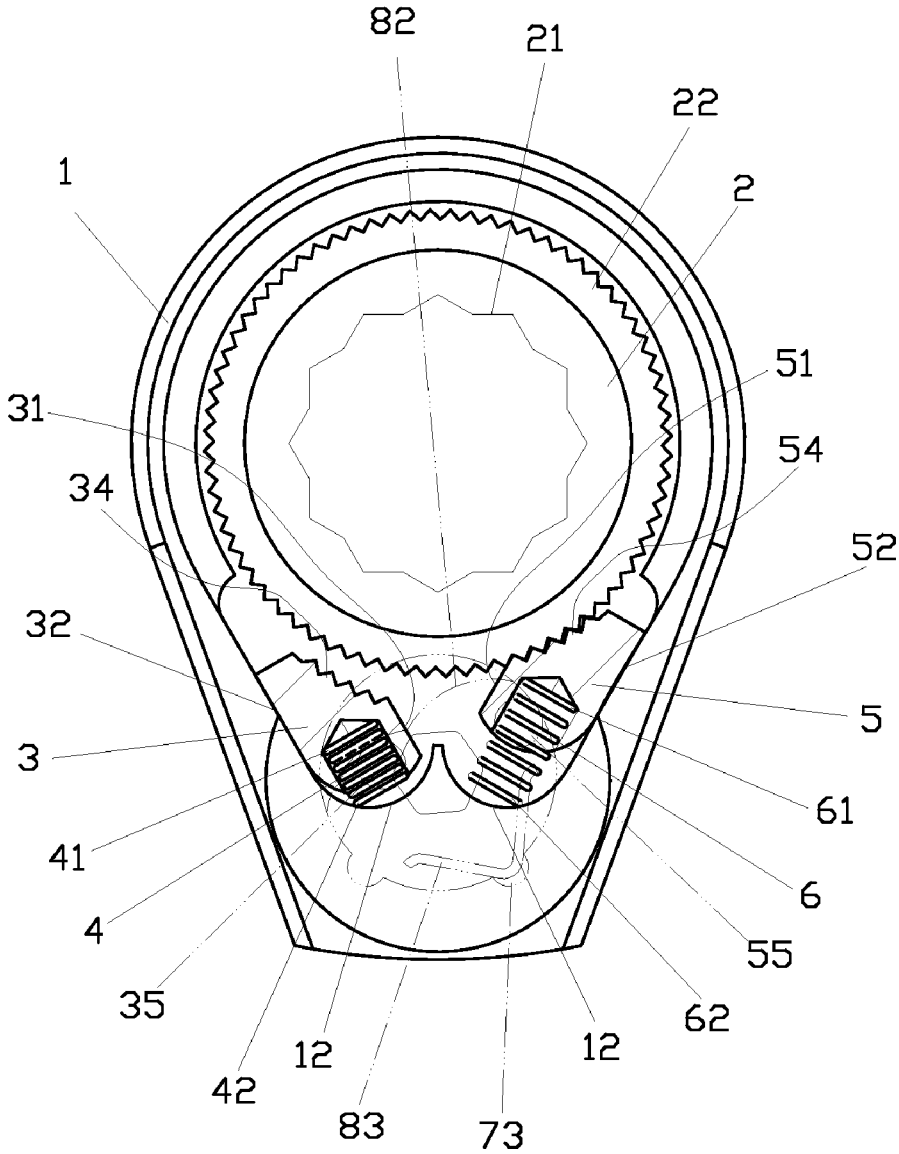
FIG. 4 is a top cross-sectional view of the present invention in a counterclockwise rotation direction.

To operate the present invention, as shown in FIGS. 3 and 4, when the knob 8 is moved to one side, the engaging block 82 links either the first stud 35 or the second stud 55 to retreat towards one side, which brings either the first detent 3 or the second detent 5 to retreat, thus either the gear teeth 34 or the gear teeth 54 disengages from the gear teeth 22 of the socket 2 so that the socket 2 is set to turn towards one direction.

FIG. 3 shows a clockwise turning direction. When the knob 8 is switched towards one side, the engaging block 82 links the second stud 55, and the gear teeth 54 of the second detent 5 disengages from the gear teeth 22 of the socket 2. By turning the handle 1 clockwise, the socket 2 engages with the rear end 32 of the first detent 3, thus the socket 2 drives the tool head to turn in a clockwise direction. If the handle 1 is turned in a counterclockwise direction, the socket 2 enforces the first detent 1 to retreat, and therefore the socket 2 will be in idle and the tool head remains still.

FIG. 4 shows a counterclockwise operation of the present invention, the operation steps are identical with FIG. 3, therefore will not be described herein.

Thus, specific embodiments and applications of ratchet structure for a wrench have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

What is claimed is:

1. A ratchet structure of a wrench comprising:

a handle comprising a chamber, a pair of recesses, a stopping ring, a first groove, and a second groove, said recesses interconnecting with said chamber, said stopping ring being disposed in a lower portion of said chamber, and said first and second grooves being disposed in an upper portion of said chamber;

a socket comprising a through hole and a first reduced section, said socket being formed with gear teeth around its outer circumference, said socket being accommodated in said chamber of said handle and stopped by said stopping ring, said gear teeth corresponding to said recesses, said socket further comprising a first fastening member corresponding in position to said first reduced section, said first fastening member being secured in said first groove and engaging with said first reduced section;

a first detent accommodated in one of said recesses of said handle and comprising a front end and a relative rear end, a flat surface being formed between said front end and said rear end, said front end comprising gear teeth corresponding to said gear teeth of said socket, said flat surface being provided with a first stud protruding thereof;

a first elastic element comprising a first end and a relative second end, said first end engaging with said rear end of said first detent, while said second end engaging with said chamber of said handle;

a second detent accommodated in the other of said recesses of said handle and comprising a front end and a relative rear end, a flat surface being formed between said front end and said rear end, said front end comprising gear teeth corresponding to said gear teeth of said socket, said flat surface being provided with a second stud protruding thereof;

a second elastic element comprising a first end and a relative second end, said first end engaging with said rear end of said second detent, while said second end engaging with said chamber of said handle;

a lid covering said first detent, said first elastic element, said second detent and said second elastic element and comprising a second reduced section, said lid being secured into said second groove with a second fastening member, said lid further comprising locating holes corresponding in position to said recesses; and a knob comprising an engaging block and a third elastic element, said engaging block being pivotally connected to said lid and engaging with said first stud and said second stud, said third elastic element being located in either of said locating holes of said lid.

2. The ratchet structure of a wrench, as recited in claim 1, wherein said first fastening member is a C-shaped clip.

3. The ratchet structure of a wrench, as recited in claim 1, wherein said second fastening member is a C-shaped clip.

* * * * *